US009091042B2

(12) United States Patent
Guimaraes et al.

(10) Patent No.: US 9,091,042 B2
(45) Date of Patent: Jul. 28, 2015

(54) WEAR ASSEMBLY FOR AN EXCAVATOR BUCKET

(75) Inventors: Miguel Guimaraes, Mackay (AU); Paul Heaphy, Stafford (AU); Andrew Drager, Goodna (AU); Ben Plant, Goodna (AU); Martial Vicq, Colmar (FR); Gérard Weber, Meyenheim (FR)

(73) Assignee: CQMS Pty Ltd, Mackay, Queesland (AU)

( * ) Notice: Subject to any disclaimer, the term of this patent is extended or adjusted under 35 U.S.C. 154(b) by 371 days.

(21) Appl. No.: 13/518,546

(22) PCT Filed: Dec. 21, 2010

(86) PCT No.: PCT/AU2010/001729

§ 371 (c)(1), (2), (4) Date: Sep. 28, 2012

(87) PCT Pub. No.: WO2011/075782

PCT Pub. Date: Jun. 30, 2011

(65) Prior Publication Data

US 2013/0008062 A1 Jan. 10, 2013

(30) Foreign Application Priority Data

Dec. 24, 2009 (AU) ..... 2009906239

(51) Int. Cl.
*E02F 9/28* (2006.01)

(52) U.S. Cl.
CPC ..... *E02F 9/2833* (2013.01); *E02F 9/2883* (2013.01); *Y10T 29/49826* (2015.01)

(58) Field of Classification Search
CPC ..... E02F 9/2825; E02F 9/2833; E02F 9/2858; E02F 9/2883; E02F 9/28
USPC ..... 37/452, 453, 454, 455, 456, 457, 458, 37/459
See application file for complete search history.

(56) References Cited

U.S. PATENT DOCUMENTS 1,805,527 A * 5/1931 Van Cortright ..... 37/454
3,191,323 A * 6/1965 Compagnoni ..... 37/455

(Continued)

FOREIGN PATENT DOCUMENTS

EP 0 414 345 A2 2/1991
WO WO 03/016640 A1 2/2003
WO WO 2007/016719 A1 2/2007

OTHER PUBLICATIONS

International Search Report and Written Opinion for Application No. PCT/AU2010/001729 dated Mar. 10, 2011.

*Primary Examiner* — Jamie L McGowan
(74) *Attorney, Agent, or Firm* — Alston & Bird LLP

(57) ABSTRACT

A wear assembly for an excavator bucket comprises a cast lip, a lower wing shroud and a retaining member. The cast lip includes two upstanding wing plates. Each wing plate has a wing face on a side of the wing plate and a plate retaining formation formed on the wing face. The plate retaining formation has a plate retaining face. The wing shroud is mounted to the wing plate. The wing shroud includes a shroud retaining formation having a shroud retaining face. The retaining member includes a first bearing formation having a first face opposing and engaging the shroud retaining face, and a second bearing formation having a second face opposing and engaging the plate retaining face. The retaining member has a longitudinal axis extending between the first bearing formation and the second bearing formation. The longitudinal axis is located in a plane substantially parallel to the wing face.

19 Claims, 10 Drawing Sheets

(56) References Cited

U.S. PATENT DOCUMENTS

| | | | | | |
|---|---|---|---|---|---|
| 3,748,762 | A | * | 7/1973 | Tarrant | 37/448 |
| 3,812,608 | A | * | 5/1974 | Ratkowski | 37/448 |
| 3,967,398 | A | | 7/1976 | Stepe | |
| 3,995,384 | A | * | 12/1976 | Wood | 37/446 |
| 4,182,057 | A | * | 1/1980 | Klett et al. | 37/448 |
| 4,290,214 | A | * | 9/1981 | Stepe | 37/448 |
| 4,776,113 | A | * | 10/1988 | Bedford et al. | 37/448 |
| 5,333,696 | A | | 8/1994 | Cornelius | |
| 5,469,648 | A | * | 11/1995 | Jones et al. | 37/457 |
| 5,561,925 | A | * | 10/1996 | Livesay | 37/455 |
| 5,802,752 | A | * | 9/1998 | Quarfordt | 37/452 |
| 6,321,471 | B2 | * | 11/2001 | Fernandez Munoz et al. | 37/456 |
| 6,735,890 | B2 | * | 5/2004 | Carpenter et al. | 37/456 |
| 6,928,759 | B2 | * | 8/2005 | Kasim | 37/452 |
| 7,100,315 | B2 | * | 9/2006 | Carpenter et al. | 37/454 |
| RE40,336 | E | * | 5/2008 | Fernandez Munoz et al. | 37/456 |
| 7,730,651 | B2 | * | 6/2010 | Carpenter | 37/452 |
| 7,739,814 | B2 | * | 6/2010 | Carpenter et al. | 37/450 |
| 7,788,830 | B2 | * | 9/2010 | Woerman et al. | 37/456 |
| 8,205,362 | B2 | * | 6/2012 | Yeomans | 37/453 |
| 8,356,432 | B2 | * | 1/2013 | Carpenter | 37/452 |
| 2001/0001352 | A1 | * | 5/2001 | Fernandez Munoz et al. | 37/455 |
| 2003/0066215 | A1 | | 4/2003 | Grant | |
| 2009/0282711 | A1 | | 11/2009 | Naher et al. | |
| 2012/0246982 | A1 | * | 10/2012 | Bentley | 37/456 |
| 2012/0304506 | A1 | * | 12/2012 | Guimaraes et al. | 37/453 |
| 2012/0304508 | A1 | * | 12/2012 | Guimaraes et al. | 37/457 |
| 2014/0026450 | A1 | * | 1/2014 | Carpenter | 37/456 |

* cited by examiner

WEAR ASSEMBLY FOR AN EXCAVATOR BUCKET

CROSS-REFERENCE TO RELATED APPLICATION

This application is the U.S. National Stage filed under 35 U.S.C. 371 of International Application No. PCT/AU2010/001729 filed Dec. 21, 2010, which designates the U.S. and was published by the International Bureau in English on Jun. 30, 2011, and which claims the benefit of Australian Application No. 2009906239, filed Dec. 24, 2009, both of which are hereby incorporated by reference in their entirety.

FIELD OF THE INVENTION

This invention is concerned with a wear assembly for an excavator bucket. The invention is concerned particularly, although not exclusively, with the releasable securing of a lower wing shroud on a cast lip.

BACKGROUND OF THE INVENTION

Excavator buckets generally include a cast lip and wear members protecting the cast lip. Cast lips generally comprise a transverse cutting bar, upwardly extending wing plates (also known as wing blocks) at opposite ends of the cutting bar and mounting noses spaced along the cutting bar. Wings of the excavator bucket are welded to the wing plates. Known wear members include cutting teeth mountable to the noses, lip shrouds mountable between the noses, and wing shrouds mountable to the wings of the excavator bucket. The wear members are all releasably secured to the cast lip by known retaining member or locking pin systems.

A known system for releasably securing a wing shroud to a wing includes a substantially horizontal passage through the wing, complementary apertures in spaced walls of the wing shroud, and a locking pin extending through the passage and the apertures to lock the wing shroud to the wing.

A lower part of the wing shroud is downwardly extending to cover a forward portion of the wing plate of the lip. The system is prone to wear as forces on the wing are transferred to the locking pin, wearing out the passage and apertures and possibly damaging the locking pin. Ingress of fines into the passage during operation of the excavator bucket may seize the locking pin in the passage.

OBJECT OF THE INVENTION

It is an object of the invention to overcome or at least alleviate one or more of the above problems and/or provide the consumer with a useful or commercial choice.

SUMMARY OF THE INVENTION

According to one aspect, the invention resides in a wear assembly for an excavator bucket, the wear assembly comprising:

a lip including an upstanding wing plate having a wing face on a side of the wing plate and a plate retaining formation formed on the wing face, the plate retaining formation having a plate retaining face;

a wing shroud mounted to the wing plate, the wing shroud including a shroud retaining formation having a shroud retaining face; and a retaining member including:

a first bearing formation having a first face opposing and engaging the shroud retaining face; and a second bearing formation having a second face opposing and engaging the plate retaining face;

wherein the retaining member has a longitudinal axis extending between the first bearing formation and the second bearing formation, the longitudinal axis located in a plane substantially parallel to the wing face of the wing plate.

The first bearing formation is preferably selectively displaceable relative to the second bearing formation.

The second bearing formation is preferably a nut, and the first bearing formation is preferably a bolt, and wherein the retaining member is a nut-and-bolt assembly comprising the nut and the bolt.

The plate retaining formation is preferably in the form of a male formation standing outwardly proud of the wing face.

The male formation preferably includes a nut capturing cavity formed therein, the nut capturing cavity including a roof having the plate retaining face.

The wing shroud preferably includes two spaced apart walls, at least one of the walls having a recess in which the male formation of the wing plate is received.

The wing shroud preferably includes a socket adapted for receiving the first bearing formation, the socket including an opening in communication with the recess, the retaining member extending through the opening in the socket.

The shroud retaining formation is preferably a shoulder of the socket which surrounds an opening.

The male formation preferably has a shank receiving channel in which part of the nut-and-bolt assembly is receivable, the shank receiving channel in communication with the nut capturing cavity.

The shank receiving channel is preferably elongate having a longitudinal axis which is located in a plane substantially parallel to the to the wing face of the wing plate.

According to another aspect of the invention there is provided a wing shroud for an excavator bucket, the wing shroud including:

two spaced walls, one of the walls having an inner face which is inwardly facing with a recess formed in the inner face, and a socket adapted to receive a head of a retaining member, the socket including:

a shoulder formation, the shoulder formation having a shroud retaining face which is in a plane substantially transverse to the inner face, and an opening which communicates with the recess.

The shroud retaining face is preferably in a plane substantially perpendicular to the inner face.

The wing shroud preferably has the recess in both of said spaced walls.

The wing shroud preferably has the socket in both of said spaced walls.

According to yet another aspect of the invention there is provided a lip for an excavator bucket, the lip including an upstanding wing plate, the wing plate having a wing face and a plate retaining formation standing outwardly proud of the wing face, the plate retaining formation having a plate retaining face which is in a plane substantially transverse to the wing face.

The plate retaining formation is preferably in the form of a male formation including a nut capturing cavity formed therein, the nut capturing cavity adapted to capture a nut, the nut capturing cavity including a roof having the plate retaining face.

The male formation preferably includes a shank receiving channel formed therein, the shank receiving channel adapted to receive a shank of a retaining member, the shank receiving channel in communication with the nut capturing cavity.

The wing plate preferably has parallel sides, the lip having said plate formation at one of the opposite sides.

According to still another aspect of the invention there is provided a method of releasably securing a wing shroud to an upstanding wing plate of a lip of an excavator bucket, the method including:

mounting the wing shroud on the wing plate by displacing the wing shroud in a direction parallel to a wing face on a side of the wing plate;

displacing a bearing formation of a retaining member in a direction parallel to a wing face of the wing plate, thereby to bear against a shroud retaining face of the wing shroud to secure the wing shroud to the wing plate.

The method preferably includes the bearing formation being displaced in the same direction as the wing shroud is displaced for mounting the wing shroud on the wing plate.

The wing shroud is preferably displaced substantially downwardly.

BRIEF DESCRIPTION OF THE DRAWINGS

In order that the invention may be more fully understood and put into practical effect, reference will now be made to the accompanying drawings in which.

DETAILED DESCRIPTION OF THE DRAWINGS

Figure 1:
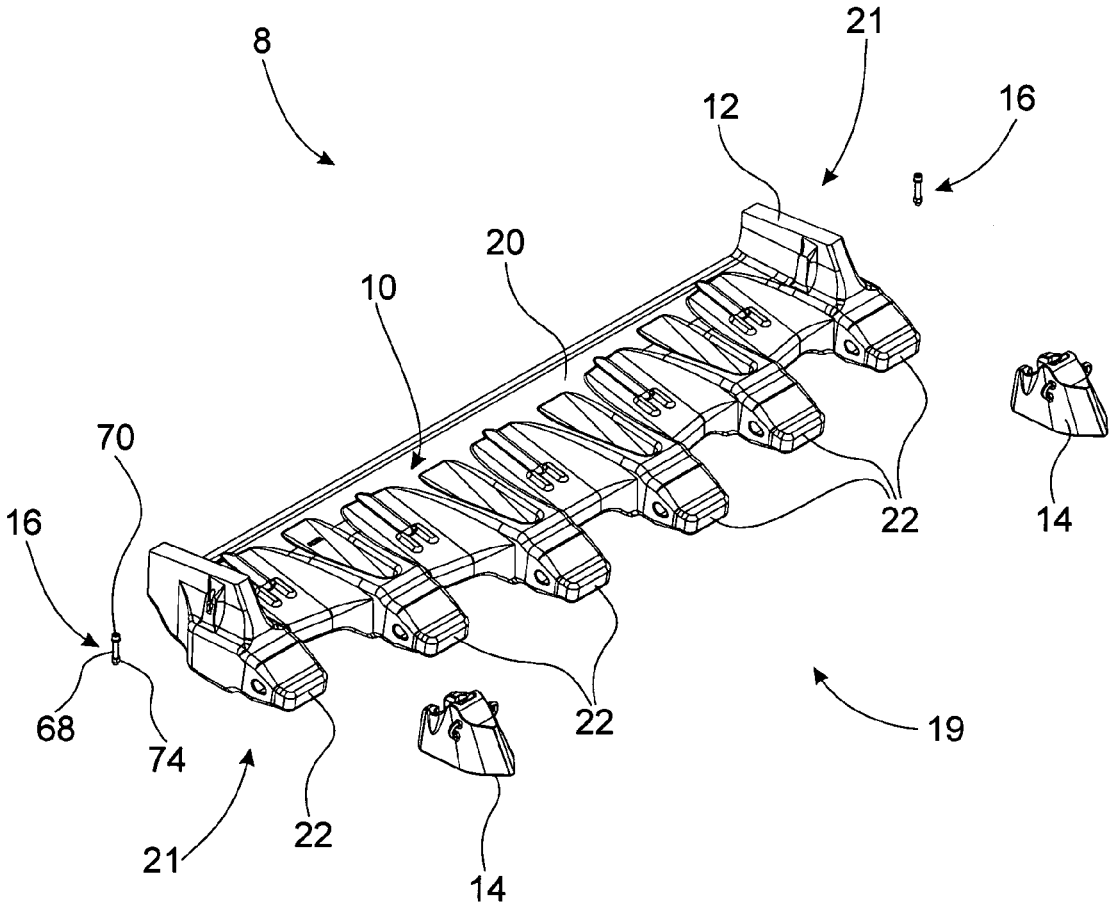
FIG. 1 shows a perspective exploded view of a wear assembly in accordance with one embodiment of the invention, the wear assembly comprises: a cast lip for an excavator bucket, two lower wing shrouds, and two retaining members in the form of nut-and-bolt assemblies.

In the accompanying drawings, for the sake of clarity, like reference numerals are employed for like features where appropriate.

FIG. 1 shows a perspective exploded view of one embodiment of a wear assembly 8 for an excavator bucket. The wear assembly 8 comprises: a cast lip 10, wear members in the form of two lower wing shrouds 14, and two retaining members in the form of nut-and-bolt assemblies 16.

The cast lip 10 comprises a cutting bar 20 which is substantially horizontal, upstanding wing plates 12 which are substantially vertically upstanding from the cutting bar 20, and mounting noses 22. The cutting bar 20 has opposite ends 21 where the wing plates 12 are located. The mounting noses 22 are spaced at intervals along the cutting bar 20 between the opposite ends 21. The mounting noses 22 are located at a front end 19 of the cutting bar 20.

The cast lip 10 is cast as an integral component from a suitably wear resistant metal alloy. The cast lip 10 is protected from wear by wear members secured to the cast lip 10. Horizontal wear members generally include digging teeth (not shown) mounted to the mounting noses 22 and horizontal shrouds (not shown) mounted between the mounting noses 22. Vertical wear members include upper wing shrouds (not shown) and the lower wing shrouds 14. The lower wing shrouds 14 protect the wing plates 12 from wear. The lower wing shrouds 14 are designed to wear during use of the excavator bucket and are thus releasably secured to the cast lip 10 so as to be replaceable.

Each nut-and-bolt assembly 16 includes a bolt 68, having a head 70. The nut-and-bolt assembly 16 further includes a nut 74 which the bolt 68 screw-threadingly engages.

Figure 2:
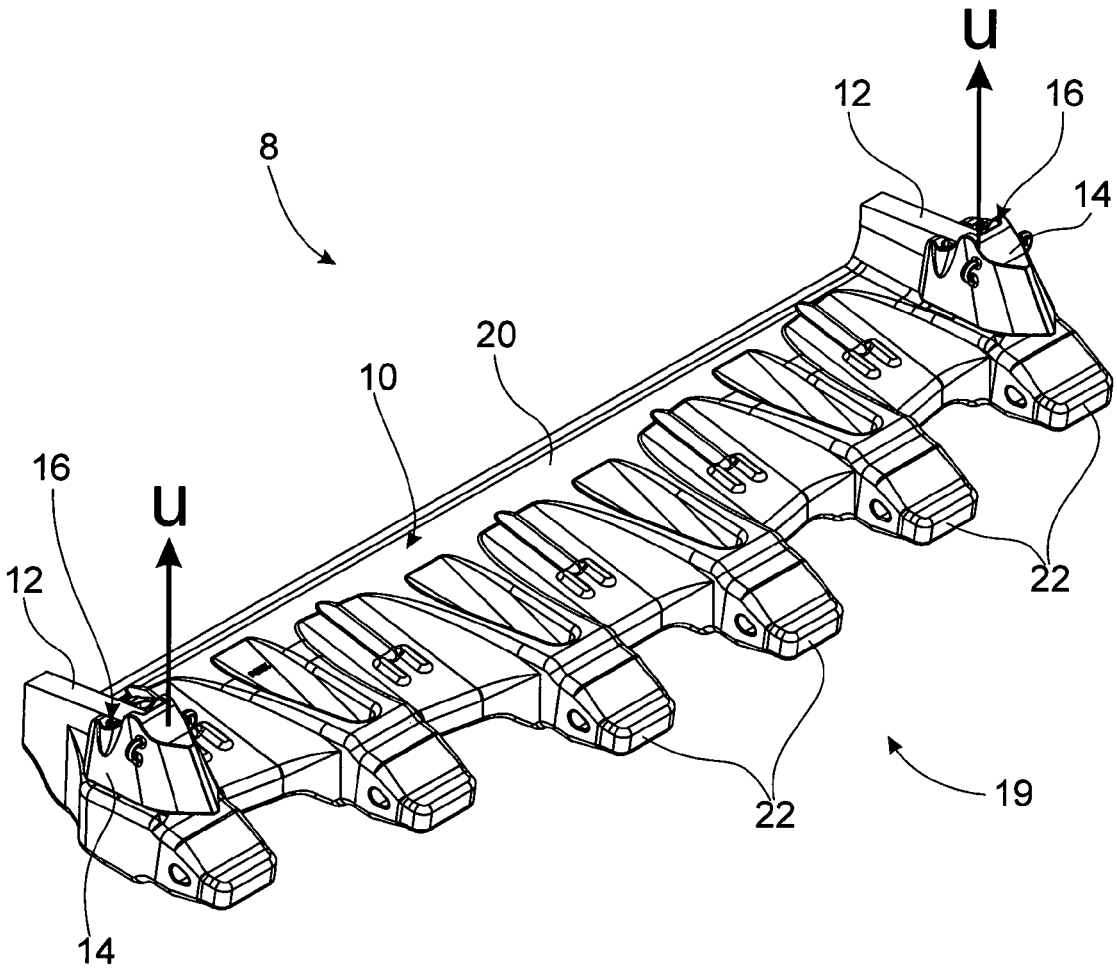
FIG. 2 shows a perspective assembled view the wear assembly of FIG. 1, showing the lower wing shrouds releasably secured to upstanding wing plates of the cast lip by the nut-and-bolt assemblies.

FIG. 2 shows a perspective assembled view of the wear assembly 8. The two lower wing shrouds 14 are shown mounted to the wing plates 12. The lower wing shrouds 14 are releasably retained on the wing plates 12 by the nut-and-bolt assemblies 16. The nut-and-bolt assemblies 16 tighten the lower wing shrouds 14 onto the cast lip 10 to prevent upward displacement of the wing shrouds 14 in the upward direction "U" relative to the wing plates 12.

Figure 3:
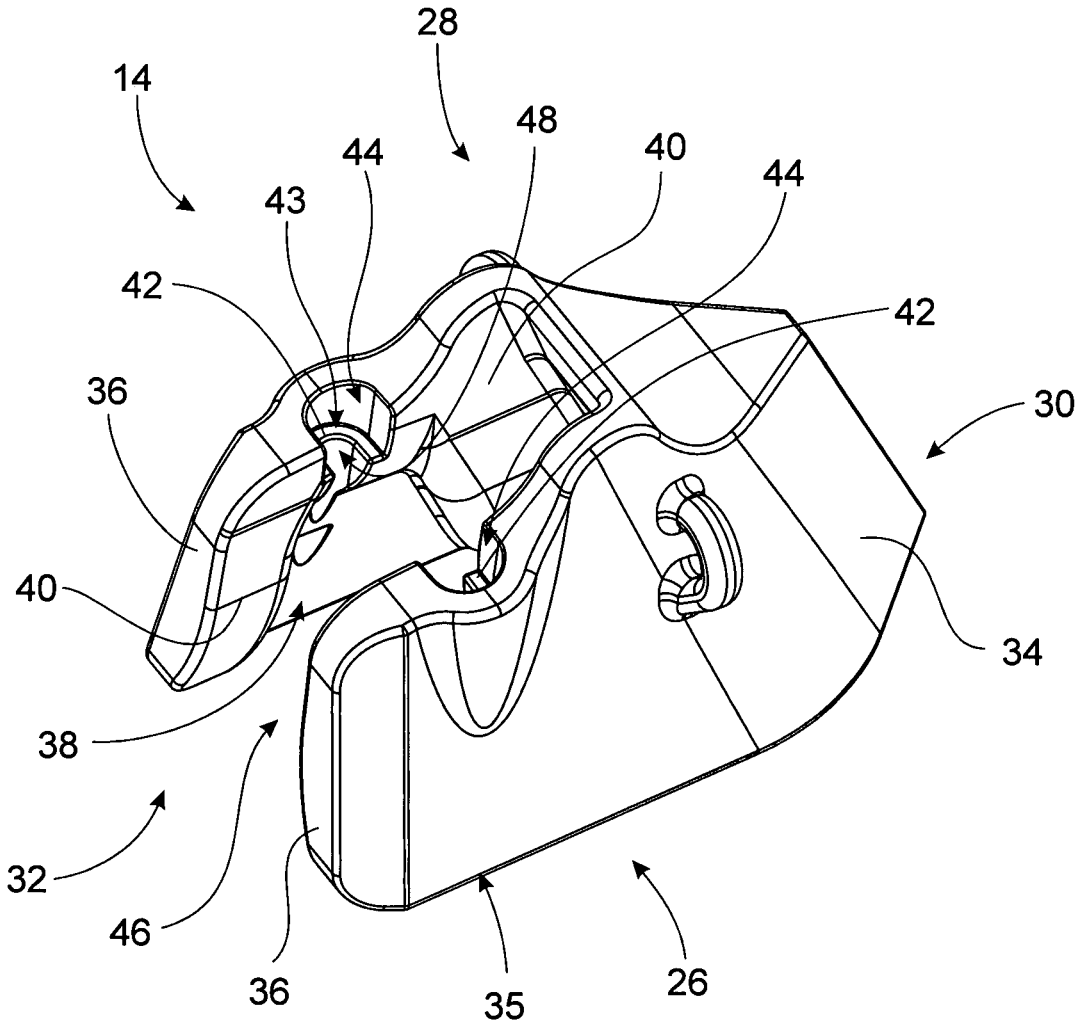
FIG. 3 shows a perspective view of one of the lower wing shrouds of FIG. 1.

FIG. 3 shows a perspective view of the lower wing shroud 14. The lower wing shroud 14 has a front end 30 and a rear end 32. The lower wing shroud 14 has an upper end 28 and a lower end 26. A nose 34 of the lower wing shroud 14 has opposed forwardly converging faces. The nose 34 is located at the front end 30. Spaced walls 36 of the shroud 14 extend from the nose 34 to the rear end 32. The walls 36 have inner faces 40 which are inwardly facing. The walls 36 have lower edges 35 at the lower end 26 of the lower wing shroud 14.

The walls 36 are adapted to received part of the wing plate 12 captured between the walls 36 when the lower wing shroud 14 is mounted on the wing plate 12. Each wall 36 has a female formation in the form of a recess 38 formed in the inner face 40 of the wall 36.

The lower wing shroud 14 includes shroud retaining formations in the form of sockets 44. The sockets 44 are formed in the walls 36 at the upper end 28 of the lower wing shroud 14. The sockets 44 each include a shroud retaining formation in the form of a shoulder 42. The socket 44 is adapted to receive the head 70 of the bolt 68 (not shown in FIG. 4). The head 70 seats against the shoulder 42. The shoulder 42 has a shroud retaining face in the form of a shoulder face 43 which the head 70 opposes and engages. The shoulder face 43 is flat planar. The shoulder face 43 is in a plane substantially transverse to the inner face 40 of the wall 36. More particularly, the shoulder face 43 is substantially perpendicular to the inner face 40. The plane in which the shoulder face 43 is located is substantially horizontal when the lower wing shroud 14 is mounted to the wing plate 12, in use.

The shoulder 42 of the socket 44 is semicircular about an opening 48 through which the shank of the bolt 68 (not shown) passes when securing the lower wing shroud 14 to the wing plate 12. The opening 48 communicates with the recess 38 in that the opening 48 is open to the recess 38.

Figure 4:
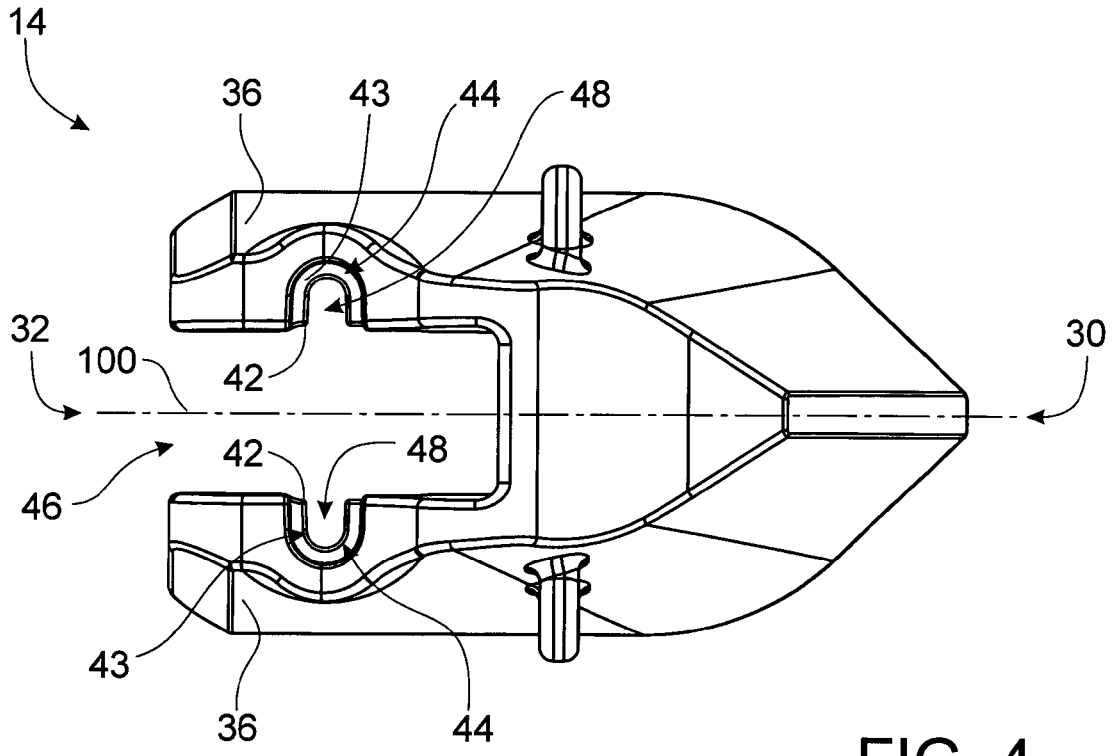
FIG. 4 shows a top view of the lower wing shroud of FIG. 3.

FIG. 4 shows a top view of the lower wing shroud 14. The lower wing shroud 14 has a gap 46 between the walls 36. Part of the wing plate 12 of the cast lip 10 is receivable in the gap 46.

The lower wing shroud 14 is symmetrical about a vertical axis 100 which extends from the front end 30 to the rear end 32. The lower wing shroud 14 being symmetric provides for the lower wing shroud 14 to be mounted to any one of the wing plates 12 at either end 21 of the cutting bar 20. The lower wing shroud 14 being mountable on any one of the wing plates 12 has the benefit that only one type of wing shroud need to be carried as inventory for replacing the wing shrouds 14 at either end 21.

Figure 5:
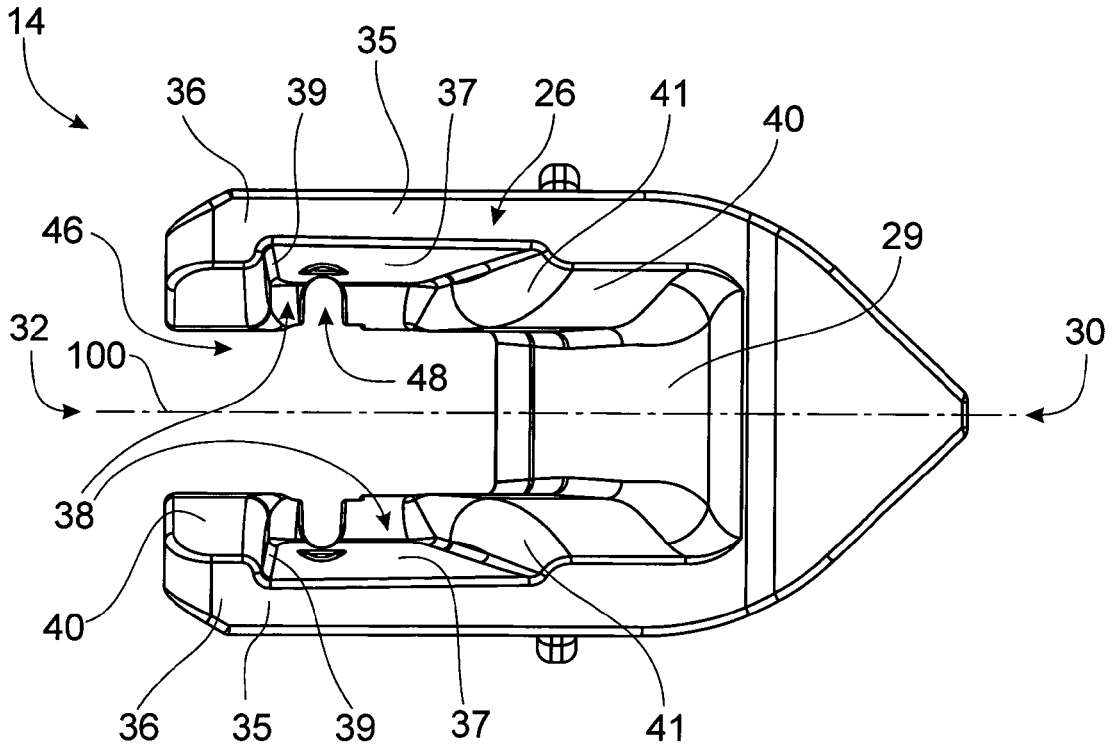
FIG. 5 shows a bottom view of the lower wing shroud of FIG. 3.

FIG. 5 shows a bottom view of the lower wing shroud 14. The recesses 38 in the faces 40 of the walls 36 are clearly shown in FIG. 5. The recesses 38 open at the lower end 26 of the lower wing shroud 14. The recess 38 has a flat floor 37. A rear abutment wall 39 of the recesses 38 defines a rear side of the recess 38. The abutment wall 39 extends inwardly from the floor 37. A forward abutment wall 41 defines a front side of the recess 38. The forward abutment wall 41 extends inwardly from the floor 37. The abutment walls 39, 41 taper outwardly from the upper end 28 to the lower end 26 of the shroud 14.

The lower wing shroud 14 has a planar inner front face 29 which extends between the walls 36 across the gap 46 at a front end of the gap 46. In use, the inner front face 29 buts against the wing plate 12 when the lower wing shroud 14 is mounted to the wing plate 12.

Figure 6:
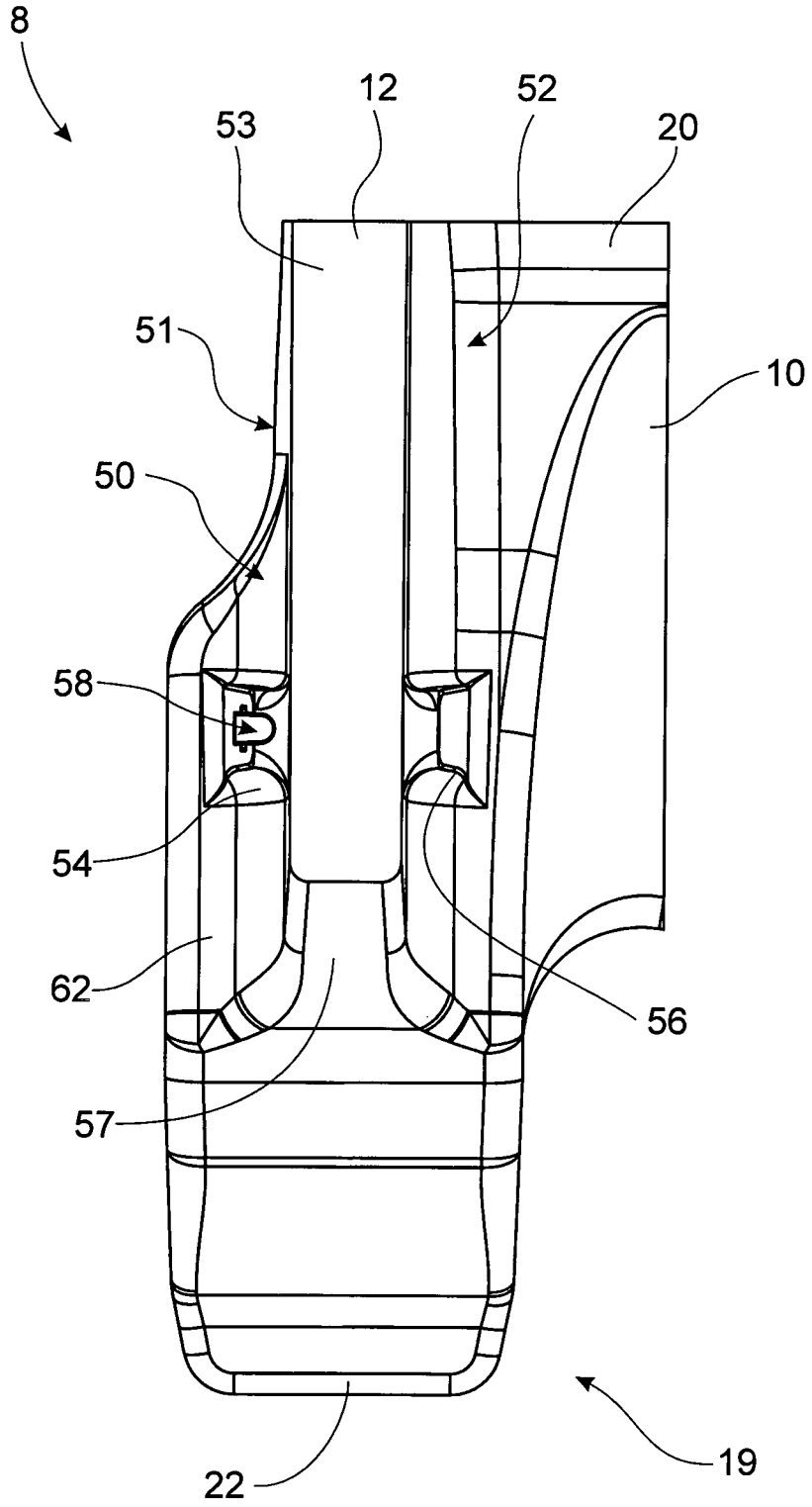
FIG. 6 shows a top view of part of the cast lip of FIG. 1 including the wing plate.

FIG. 6 shows a top view of the wing plate 12 and part of the cutting bar 20. The wing plate 12 has an upper surface 53 at its top, to which a wing of the excavator bucket welds. The lower wing shroud 14 protects a lower end region of the wing of the excavator buckets and the weld joint between the wing and the wing plate 12.

The wing plate 12 has parallel opposite sides 50, 52. The side 50 has a planar wing face 51. Male formations 54, 56 are formed on the sides 50,52 respectively. The male formations 54,56 stand outwardly proud on the sides 50,52. The male formations 54, 56 are complementary-shaped to the recesses 38 in the shroud 14, thereby to be received in the recesses 38.

A plate retaining formation of the wing plate 12 is in the form of the male formation 54 formed on the wing face 51. The male formation 54 has a bolt shank receiving channel 58 and a nut capturing cavity 60 (shown in FIG. 7) formed therein. The bolt shank receiving channel 58 is vertically upwardly extending.

The wing plate 12 has a front face 57 against which the inner front face 29 of the lower wing shroud 14 buts.

Figure 7:
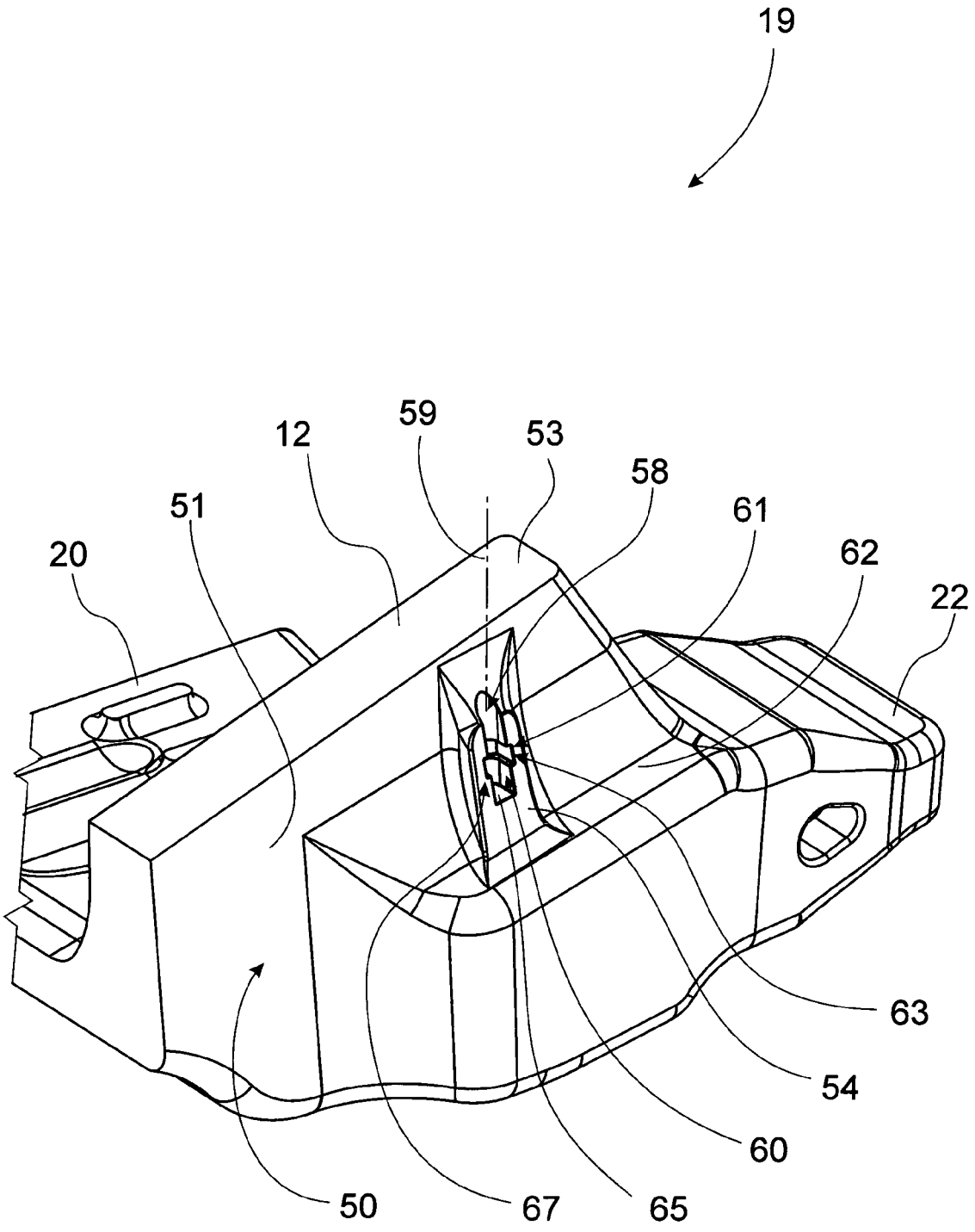
FIG. 7 shows a perspective view of the part of the cast lip of FIG. 6.

FIG. 7 shows a perspective view of the wing plate 12. The bolt shank receiving channel 58 and nut capturing cavity 60 are formed in the male formation 54. The nut capturing cavity 60 is at a lower end region of the bolt shank receiving channel 58. The bolt shank receiving channel 58 traverses the nut capturing cavity 60. The bolt shank receiving channel 58 is thus in communication with the nut capturing cavity 60. The bolt shank receiving channel 58 has a longitudinal axis 59. The longitudinal axis 59 is in a plane which is parallel to the wing face 51. The longitudinal axis 59 is vertically upwardly extending.

The nut capturing cavity 60 is adapted to prevent rotation of a nut 74 (shown in FIG. 8) received in the nut capturing cavity 60. The nut capturing cavity 60 is defined by a roof 61, a floor 63 and flat faces 65 which extend between the roof 61 and the floor 63. The bolt shank receiving channel 58 passes through the roof 61 and the floor 63. The flat faces 65 oppose and engage side faces of the nut 74 to prevent rotation of the nut 74 in the nut capturing cavity 60.

The roof 61 has a plate retaining face in the form of a roof face 67 which the nut 74 engages when displaced upwardly as described in more detail with reference to FIG. 10. The roof face 67 is substantially transverse to the wing face 51. More particularly, the roof face 67 is perpendicular to the wing face 51.

The cast lip 10 has a step 62 surrounding a part of the wing plate 12. In use, a lower edge of the walls 36 of the shroud 14 abuts against the step 62 when the shroud 14 is mounted to the wing plate 12. The step 62 forms part of a formation supporting the nose 22.

Figure 8:
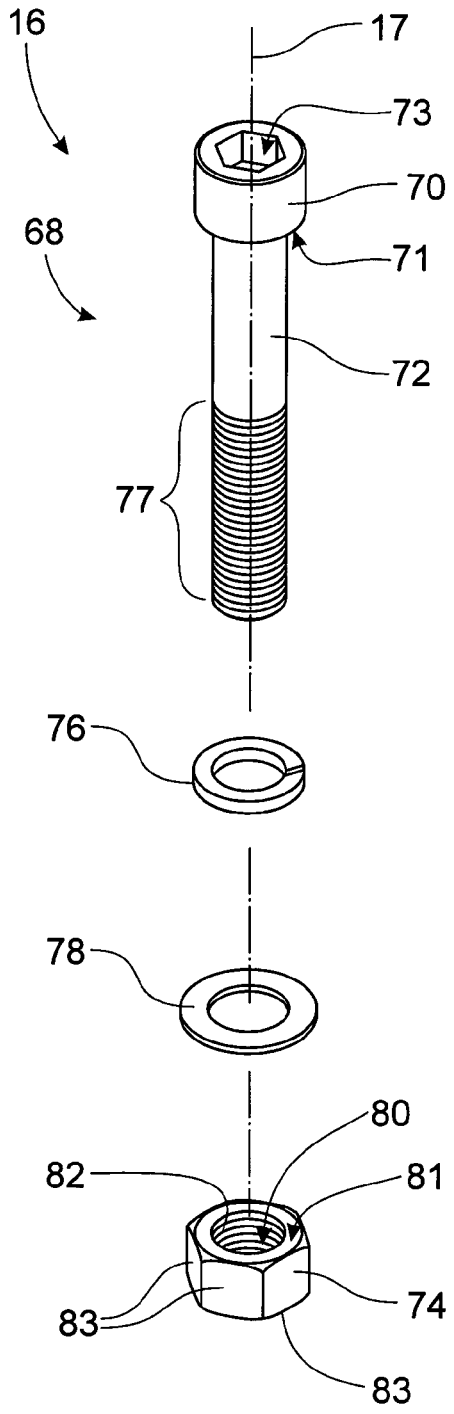
FIG. 8 shows a perspective exploded view of one of the nut-and-bolt assemblies of FIG. 1.

FIG. 8 shows a perspective exploded view of the nut-and bolt assembly 16. The nut-and-bolt assembly 16 has a longitudinal axis 17.

The nut-and-bolt assembly 16 comprises a first bearing formation in the form of the head 70 of the bolt 68 and a second bearing formation in the form of the nut 74. The nut-and-bolt assembly also includes a spring washer 76 and plain washer 78.

The bolt 68 comprises the head 70 and a shank 72. The shank 72 extends from the head 70 along the longitudinal axis 17. A screw-threaded end region 77 of the shank 72 has a screw thread.

The head 70 has a first face in the form of a bolt head face 71. The shank 72 extends from the bolt head face 71. The head 70 is round and has a hexagon socket 73 in which a key of a driving tool can be received to loosen or tighten the bolt 68.

The plain washer 78 spreads a load applied by the head 70. The spring washer 76 has flexibility along the longitudinal axis 17 and is used to prevent loosening of the nut-and-bolt assembly 16 due to vibrations.

The nut 74 has a hole 80 with an internal thread 82. The nut 74 has a second face in the form of a nut face 81. Side faces 83 of the nut 74 are substantially square with the nut face 81. The bolt head face 71 of the head 70 of the bolt 68 opposes the nut face 81 of the nut 74.

Figure 9:
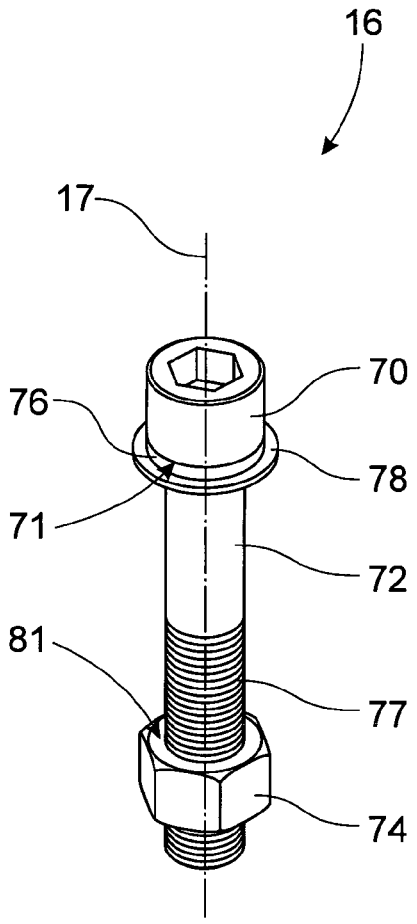
FIG. 9 shows a perspective assembled view of the nut-and-bolt assembly of FIG. 9.

FIG. 9 shows a perspective assembled view of the nut-and-bolt assembly 16. The nut 74 screws onto the screw-threaded end region 77 of the bolt 68. The nut 74 is displaceable along the shank 72 by rotation of the bolt 68 relative to the nut 74. The spring washer 76 sits below the head 70 in abutment with the bolt head face 71. The plain washer 78 sits below the spring washer 76 and is in abutment with the spring washer 76.

Figure 10:
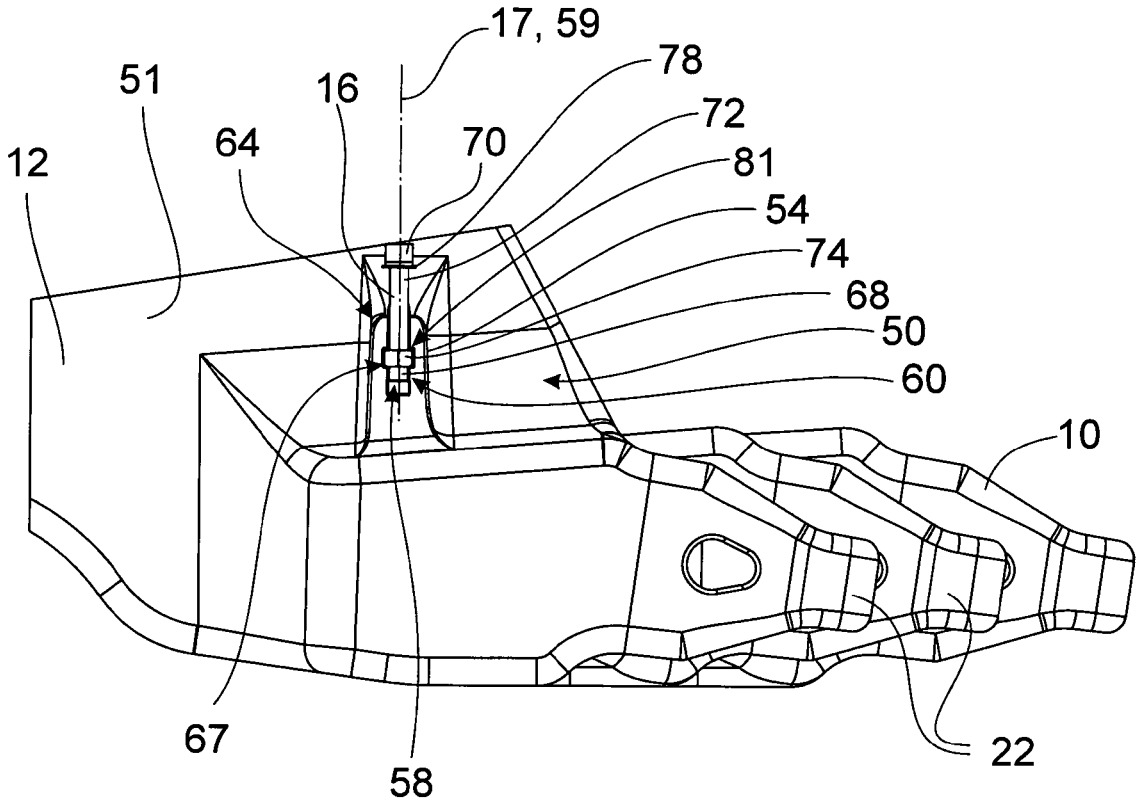
FIG. 10 shows a side view of the part of the lip of FIG. 6 and the nut-and-bolt assembly releasably securing a lower wing shroud to the cast lip.

FIG. 10 shows a side view of the wing plate 12 showing the nut-and-bolt assembly 16 partly received in the male formation 54 on the wing face 51 of the wing plate 12.

The nut 74 is captively held in the nut capturing cavity 60 of the male formation 54. The nut 74 is held between the roof 61 and the floor 63 of the nut capturing cavity 60. The nut face 81 of the nut 74 opposes and engages the roof face 67 of the nut capturing cavity 60. Displacing the nut 74, upwardly along the longitudinal axis 59 of the bolt shank receiving channel 58 causes the nut face 81 to bear against the roof face 67. It will be appreciated by those skilled in the art that the nut 74 may be integrally formed with the nut capturing cavity 60.

The bolt 68 is screwed into the nut 74. The shank 72 of the nut 74 is received in the bolt shank receiving channel 58. The longitudinal axis 17 of the nut-and-bolt assembly 16 is in the same plane as the longitudinal axis 59 of the bolt shank receiving channel 58. That is to say the longitudinal axis 17 of the nut-and-bolt assembly 16 is in a plane parallel to the wing face 51. The longitudinal axis 17 of the nut-and-bolt assembly 16 is the same as the longitudinal axis 59 of the bolt shank receiving channel 58 when the lower wing shroud 14 is mounted to the wing plate 12.

The head 70 of the bolt 68 is displaceable along the longitudinal axis 59 of the bolt shank receiving channel 58 by screwing the bolt 68 into and out of the nut 74.

Figure 11:
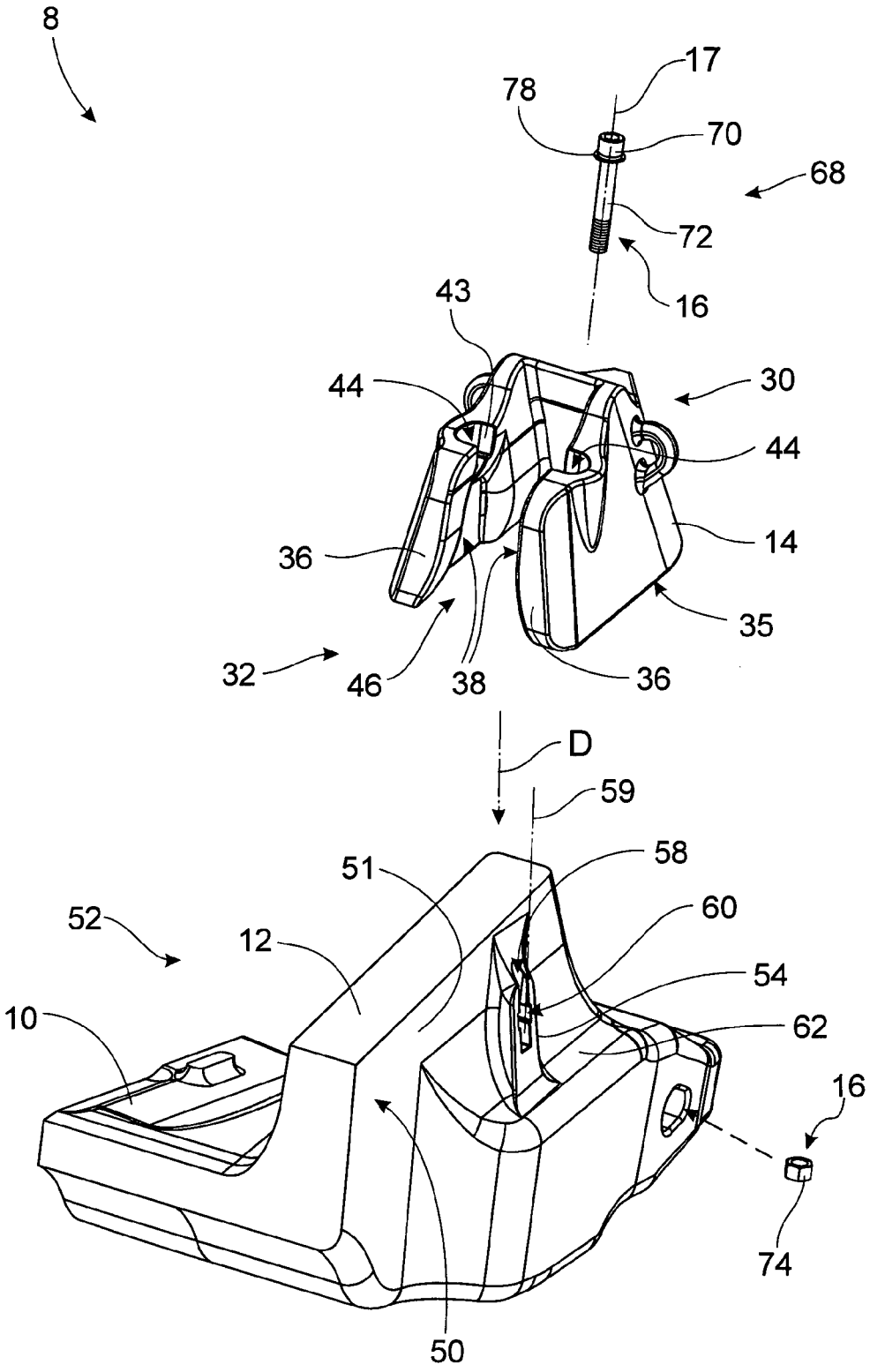
FIG. 11 shows an exploded perspective view of the wear assembly of FIG. 1.

FIG. 11 shows an exploded view of the wear assembly 8. Assembled, the lower wing shroud 14 is located on the cast lip 10 with part of the wing plate 12 received in the gap 46 between the walls 36. The lower wing shroud 14 is lowered onto the cast lip 10 along in the downward direction "D". The downward direction "D" is parallel to the wing face 51. The male formations 54,56 on the wing plate 12 are received in the recesses 38 in the walls 36. The lower edges 35 of the walls 36 of the lower wing shroud 14 seat on the step 62 of the lip cast 10.

The male formations 54,56 are in mating engagement with the recesses 38 in the walls 36 to stop forward movement of the lower wing shroud 14 relative to the wing plate 12. Specifically, the rear abutment wall 39 of the recesses 38 oppose and engaging the male formations 54,56. The mating engagement between the male formations 54, 56 and the recesses 38 prevent the lower wing shroud 14 from being pulled off the wing plate 12.

The nut-and-bolt assembly 16 secures the lower wing shroud 14 to the wing plate 12. The head 70 of the bolt 68 is received in the socket 44 corresponding with the bolt shank receiving channel 58, as shown in more detail in FIG. 12. The head 70 seats against the shoulder 42 in the socket 44 so that the bolt head face 71 opposes and engages the shoulder face 43 of the socket 44. The spring washer 76 and lock washer 78 are located between the bolt head face 71 and the shoulder face 43. The head 70 bears against the shoulder 42 via the washers 76, 78.

The lower wing shroud 14 is screwed down onto the cast lip 10 by turning the bolt 68 in one direction to tighten the bolt 68. Similarly, the lower wing shroud 14 may be released from the cast lip 10 by turning the bolt 18 in the opposite direction to loosen the bolt 68 and remove the bolt 68. The nut-and-bolt assembly 16 prevents vertical upward movement of the lower wing shroud 14 relative to the wing plate 12 when the bolt 68 is tightened. The nut-and-bolt assembly 16 effectively clamps the lower wing shroud 14 to the wing plate 12 by engagement of the bolt head face 71 with the shoulder face 43 at one end of the nut-and-bolt assembly 16 and engagement of the nut face 81 with the roof face 67 at the other end of the nut-and-bolt assembly 16.

Figure 12:
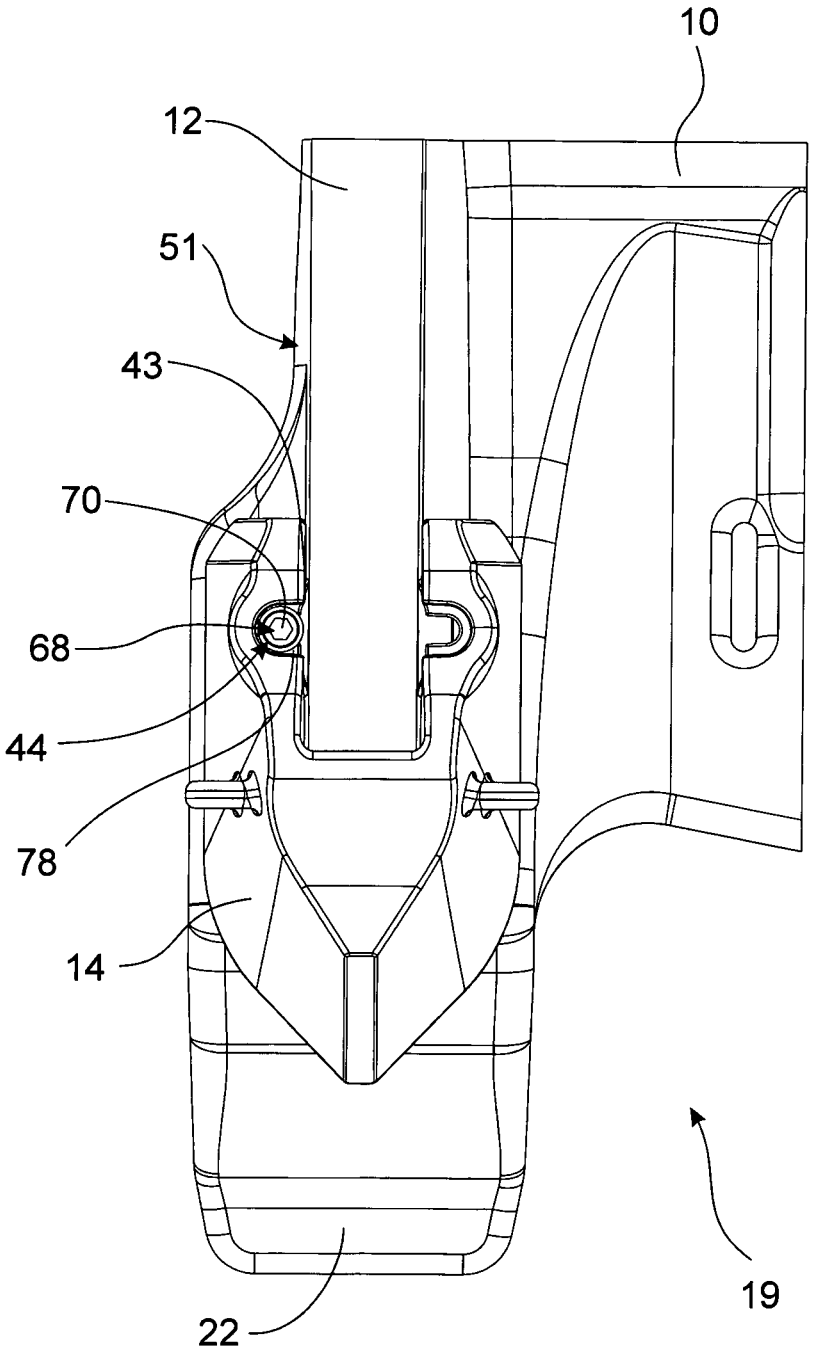
FIG. 12 shows a top view of the lower wing shroud releasably secured to the wing plate of the lip in an assembled condition of the wear assembly.

FIG. 12 shows a top view of the lower wing shroud 14 releasably secured to the wing plate 12 in an assembled condition of the wear assembly 8. The head 70 of the bolt 68 is shown located in the socket 44. The bolt head face 71 of the head 70 bears against the shoulder face 43. The plain washer 78 is seated on the shoulder face 43.

The wear assembly 8 does not require any horizontal holes through the wing plate 12 to mount the lower wing shroud 14 to the wing plate 12. Holes through the wing plate 12 may weaken the wing plate 12 and it is beneficial that the wear assembly 8 avoids horizontal holes. Welding of locking components to the wing plate 12 is also not required. It will be appreciated by those skilled in the art that it is desirable to limit welding at the wing shroud 12.

Major digging forces on the lower wing shroud 14 during a digging cycle are substantially horizontal in a direction from the front end 30 of the lower wing shroud 14 to the rear end 32 of the lower wing shroud 14. The wear assembly 8 is adapted so that the lock assembly 16 is substantially isolated from the major digging forces by extending substantially perpendicular to the major digging forces.

The walls 36 of the lower wing shroud 14 shield the lock assembly 16 from material flow. By shielding the lock assemblies 16, the lock assemblies are reasonably long wearing relative to the wing shrouds 14.

Secure retainment of the lower wing shroud 14 to the wing plate 12 by the nut-and-bolt assembly 16 helps prevent relative movement of the lower wing shroud 14 with respect to the wing plate 12. This may assist in preventing the ingress of fines between the lower wing shroud 14 and the wing plate 12, which can cause cementation between the wing shroud 14 and the wing plate 12.

Throughout the specification the aim has been to describe the invention without limiting the invention to any one embodiment or specific collection of features. Persons skilled in the relevant art may realize variations from the specific embodiments that will nonetheless fall within the scope of the invention. For example, only the male formation 54 is described as being adapted to receive part of the nut-and-bolt assembly 16. The male formation 56 may similarly be adapted to receive part of another nut-and-bolt assembly 16 so that the lower wing shroud 14 is releasably secured on both sides 50,52 of the wing plate 12.

It will be appreciated that various other changes and modifications may be made to the embodiment described without departing from the spirit and scope of the invention.

The invention claimed is:

1. A wear assembly for an excavator bucket, the wear assembly comprising:
   - a lip including an upstanding wing plate having a wing face on a side of the wing plate and a plate retaining formation formed on the wing face, the plate retaining formation having a plate retaining face;
   - a wing shroud mounted to the wing plate, the wing shroud including a shroud retaining formation having a shroud retaining face; and
   - a retaining member including:
     - a first bearing formation having a first face opposing and engaging the shroud retaining face; and
     - a second bearing formation having a second face opposing and engaging the plate retaining face;
   - wherein the retaining member has a longitudinal axis extending between the first bearing formation and the second bearing formation, the longitudinal axis located in a plane substantially parallel to the wing face of the wing plate, and
   - wherein the wing shroud includes a socket adapted for receiving the first bearing formation the socket including an opening the retaining member extending through the opening in the socket.

2. The wear assembly of claim 1, wherein the first bearing formation is selectively displaceable relative to the second bearing formation.

3. The wear assembly of claim 1, wherein the second bearing formation is a nut, and the first bearing formation is a bolt, and wherein the retaining member is a nut-and-bolt assembly comprising the nut and the bolt.

4. The wear assembly of claim 1, wherein the plate retaining formation is in the form of a male formation standing outwardly proud of the wing face.

5. The wear assembly of claim 4, wherein the wing shroud includes two spaced apart walls, at least one of the walls having a recess wherein the male formation of the wing plate is received.

6. The wear assembly of claim 5, wherein the opening of the socket is in communication with the recess.

7. The wear assembly of claim 6, wherein the shroud retaining formation is a shoulder of the socket, the shoulder surrounding the opening.

8. The wear assembly of any one of claim 4, wherein the male formation includes a nut capturing cavity formed therein, the nut capturing cavity including a roof having the plate retaining face.

9. The wear assembly of claim 8, wherein the male formation has a shank receiving channel wherein part of the retaining member is receivable, the shank receiving channel in communication with the nut capturing cavity.

10. The wear assembly of claim 9, wherein the shank receiving channel is elongate having a longitudinal axis, the longitudinal axis located in a plane substantially parallel to the to the wing face of the wing plate.

11. A wing shroud for an excavator bucket, the wing shroud including:

a front end and a rear end;

two spaced walls extending in a direction from the front end to the rear end, one of the walls having an inner face which is inwardly facing with a recess formed in the inner face, and a socket adapted to receive a head of a retaining member, the socket including:

a shoulder formation, the shoulder formation having a shroud retaining face which is in a plane that is substantially transverse to the inner face and extends in a direction from the front end to the rear end, and an opening which communicates with the recess.

12. The wing shroud of claim 11, wherein the shroud retaining face is in a plane substantially perpendicular to the inner face.

13. The wing shroud of claim 11, wherein the wing shroud has the recess in both of said spaced walls.

14. The wing shroud of claim 11, wherein the wing shroud has the socket in both of said spaced walls.

15. A lip for an excavator bucket, the lip including an upstanding wing plate, the wing plate having a wing face and a plate retaining formation standing outwardly proud of the wing face, the plate retaining formation having a plate retaining face, the plate retaining face in a plane substantially transverse to the wing face, wherein the plate retaining formation is in the form of a male formation including a nut capturing a cavity formed therein, the nut capturing cavity adapted to capture a nut, the nut capturing cavity including a roof having the plate retaining face.

16. The lip of claim 15, wherein the male formation includes a shank receiving channel formed therein, the shank receiving channel adapted to receive a shank of a retaining member, the shank receiving channel in communication with the nut capturing cavity.

17. The lip of claim 15, wherein the wing plate has parallel sides, the lip having said plate formation at one of the opposite sides.

18. A method of releasably securing a wing shroud to an upstanding wing plate of a lip of an excavator bucket, the method including:

mounting the wing shroud on the wing plate by displacing the wing shroud in a direction parallel to a wing face on a side of the wing plate; and displacing a bearing formation of a retaining member in a direction parallel to a wing face of the wing plate, thereby to bear against a shroud retaining face of the wing shroud to secure the wing shroud to the wing plate, wherein the bearing formation is displaced in the same direction as the wing shroud is displaced for mounting the wing shroud on the wing plate.

19. The method of claim 18, wherein the bearing formation is displaced substantially downwardly.

* * * * *